US006318582B1

(12) United States Patent
Mallinger et al.

(10) Patent No.: US 6,318,582 B1
(45) Date of Patent: Nov. 20, 2001

(54) ENAMELED SLIDE-IN UNIT

(75) Inventors: Peter Mallinger, Traunreut; Peter Lohner, Altenmarkt, both of (DE)

(73) Assignee: Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 09/505,377

(22) Filed: Feb. 16, 2000

(30) Foreign Application Priority Data

Feb. 16, 1999 (DE) ..... 199 06 364

(51) Int. Cl.[7] ..... A47J 27/00
(52) U.S. Cl. ..... 220/573.1; 220/640; 220/641
(58) Field of Search ..... 220/641, 654, 220/640, 573.1

(56) References Cited

U.S. PATENT DOCUMENTS

| | | | | |
|---|---|---|---|---|
| 769,271 | * | 9/1904 | Norquist | 220/641 |
| 1,303,465 | * | 5/1919 | Du Bois | 220/654 |
| 1,807,394 | * | 5/1931 | Dunham | 220/654 |
| 2,040,996 | | 5/1936 | Hungerford . | |
| 2,216,147 | * | 10/1940 | Ward | 220/641 |
| 2,474,102 | * | 6/1949 | Gershon | 220/640 |
| 2,628,739 | * | 2/1953 | Vischer, Jr. | 220/640 |
| 3,622,037 | * | 11/1971 | Gildart | 220/643 |
| 4,717,038 | * | 1/1988 | Anders | 220/640 |
| 4,721,040 | * | 1/1988 | Mau | 220/640 |

FOREIGN PATENT DOCUMENTS

| | | | | |
|---|---|---|---|---|
| 532137 | * | 10/1954 | (BE) | 220/641 |
| 35 44 582 C2 | | 6/1987 | (DE) . | |

* cited by examiner

*Primary Examiner*—Joseph M. Moy
(74) *Attorney, Agent, or Firm*—Herbert L. Lerner; Laurence A. Greenberg; Werner H. Stemer

(57) ABSTRACT

A slide-in unit for a baking oven with enameled guideways in oven muffle sidewall regions includes a tray with two opposite lateral supporting regions each respectively with a curled lateral edge region having at least one notch and a sliding clip clampingly secured in the edge region of the supporting regions, the clip protruding from the at least one notch and used as a sliding support for the tray. The slide-in unit can be, for example, a baking sheet. The invention also includes an improved support for a slide-in unit having two opposite lateral supporting regions each respectively with a downwardly curled lateral edge region having at least one notch for a baking oven with enameled guideways in the oven muffle sidewall regions. The improvement includes a sliding clip clampingly secured in an edge region of supporting regions of a slide-in unit, the clip protruding from notches of the edge region as a sliding support for the slide-in unit.

9 Claims, 1 Drawing Sheet

ENAMELED SLIDE-IN UNIT

BACKGROUND OF THE INVENTION

Field of the Invention

The invention lies in the field of appliances. The present invention relates to an enameled slide-in unit, such as a baking sheet, for example. Particularly, the invention relates to slide-in baking sheet for use in a baking oven having enameled guideways in the oven muffle sidewall regions. The baking sheet has two opposite lateral supporting regions that respectively have a downwardly curled lateral edge region, to which is secured a metallic sliding support for the slide-in unit. The lateral supporting regions are guided in and held within the oven guideways.

German Patent No. 35 44 582 C2 discloses a slide-in unit having a sliding and supporting region that is drawn out laterally from a baking sheet and is constructed by being drawn downward and offset inward. The sliding and supporting region is surrounded by a metal profile. The production and assembly of the metal profile, however, is complex.

SUMMARY OF THE INVENTION

It is accordingly an object of the invention to provide an enameled slide-in unit that overcomes the hereinafore-mentioned disadvantages of the heretofore-known devices of this general type and that simplifies the construction of the slide-in unit.

With the foregoing and other objects in view, there is provided, in accordance with the invention, a slide-in unit for a baking oven with enameled guideways in oven muffle sidewall regions, the slide-in unit including a tray with two opposite lateral supporting regions each respectively with a curled lateral edge region having at least one notch, and a sliding clip clampingly secured in the edge region of the supporting regions, the clip protruding from the at least one notch as a sliding support for the tray.

The object of the invention is achieved by a sliding clip being clampingly secured in the edge region with the clip protruding from at least two notches of the curled edge region and being used as a sliding support of the slide-in unit. By using the sliding clip according to the invention, it is possible to dispense with the complex production and assembly of the profiled part according to the prior art.

In accordance with another feature of the invention, the tray is enameled.

In accordance with a further feature of the invention, the lateral edge region is downwardly curled.

In accordance with an added feature of the invention, the clip has a top and is covered on the top by the edge region. To increase the immunity to soiling and the ease of cleaning, the sliding clip is covered essentially completely on top by the edge region of the slide-in unit.

In accordance with an additional feature of the invention, the clip is two clips, a respective one of the two clips disposed in each of the two supporting regions. To simplify assembly, there is one sliding clip provided in each of the two lateral supporting regions, that is to say two sliding clips per slide-in unit.

In accordance with yet another feature of the invention, the at least one notch is two notches formed in the edge region and the two notches are spaced apart from one another in the edge region. To allow stable and, as far as possible, rattle-free guidance of the slide-in unit in the side walls of the oven muffle, two notches are formed in the edge region of the slide-in unit and the notches are preferably spaced as far apart from one another as possible.

In accordance with yet a further feature of the invention, the edge region has a length with two ends and the two notches are spaced apart from one another at the ends of the edge region.

In accordance with yet an added feature of the invention, the tray has corner regions and sides and the at least one notch is formed in a respective one of the corner regions and extends into respective neighboring sides of the tray. To simplify assembly of the sliding clip, the notches are formed in the corner regions of the slide-in unit, with the notches extending into both neighboring longitudinal sides of the slide-in unit.

In accordance with a concomitant feature of the invention, there is also provided an improved support for a slide-in unit having two opposite lateral supporting regions each respectively with a downwardly curled lateral edge region having at least one notch for a baking oven with enameled guideways in the oven muffle sidewall regions, the improvement including a sliding clip clampingly secured in an edge region of supporting regions of a slide-in unit, the clip protruding from notches of the edge region as a sliding support for the slide-in unit.

Other features that are considered as characteristic for the invention are set forth in the appended claims.

Although the invention is illustrated and described herein as embodied in an enameled slide-in unit, it is nevertheless not intended to be limited to the details shown, because various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
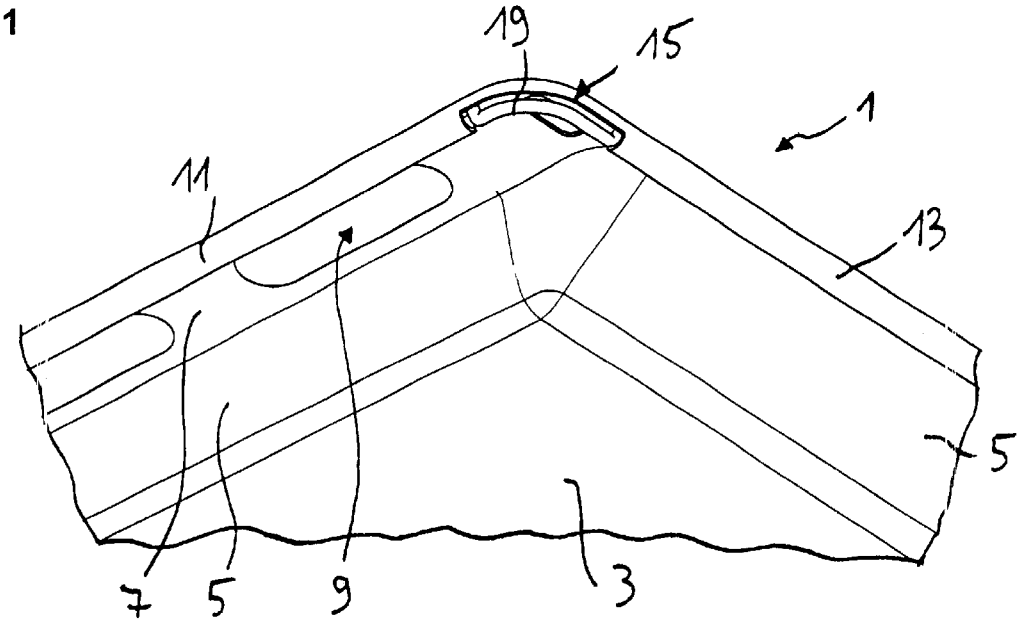
FIG. 1 is a diagrammatic, fragmentary, perspective view from below the slide-in unit according to the invention with the sliding clip in the assembled state.

Description of the Preferred Embodiments:

A pan-shaped enameled baking sheet 1 with a base 3 and four side walls 5 can be slid in enameled non-illustrated conventional guideways in the sidewall regions of the oven muffle of a baking oven. For cooperation with the sidewall regions of the oven muffle, the baking sheet 1 respectively has a supporting region 7 that is bent away at right angles from the side wall 5 and extends essentially horizontally. Air passages 9 are provided over the entire depth of the baking sheet 1 in the supporting region 7 (which is typically a side region of the baking sheet 1) and, in spite of the fact that the baking sheet 1 is slid-in, the passages 9 permit good hot air distribution in the oven muffle during circulating air operation of the conventional baking oven. The air passages 9 may, however, also be provided in the front region 13 and the rear region of the baking sheet 1, and, if appropriate, may be made much narrower than shown or even omitted entirely. Consequently, the supporting region 7 of the baking sheet 1 may be made significantly narrower, thereby increasing the useful surface area available on the baking sheet 1.

Figure 2:
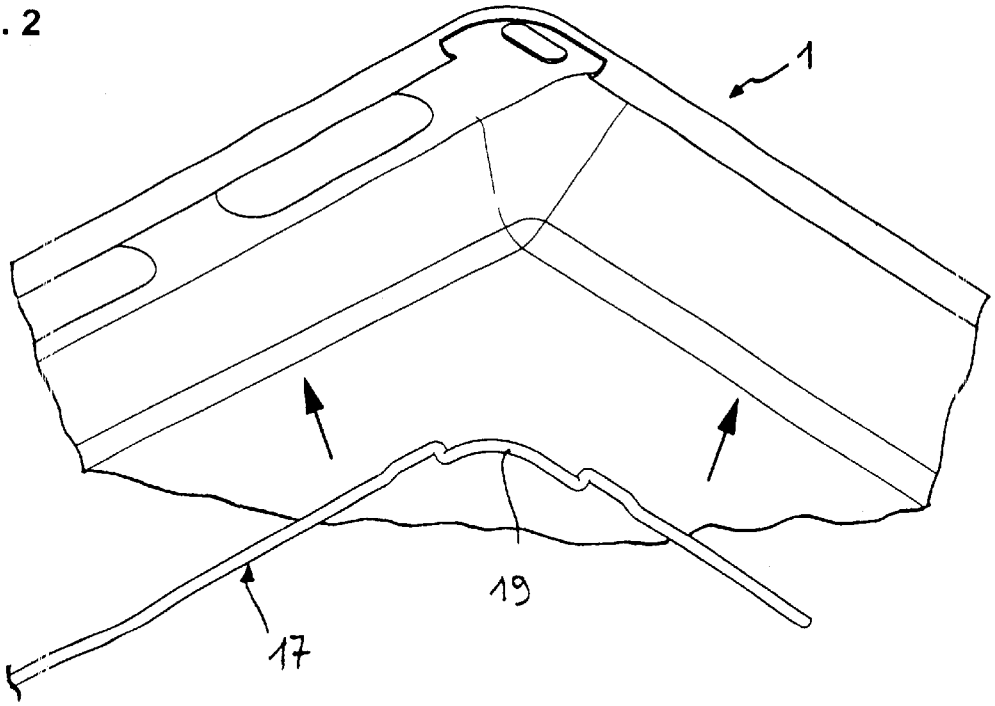
FIG. 2 is the same view of FIG. 1 with the sliding clip in the disassembled state.

The lateral end portion of the supporting region 7 of the baking sheet 1 is formed as a curled edge region 11 over its entire breadth. A front region 13 and a non-illustrated rear region of the baking sheet 1 may be configured in a corresponding way. A notch 15 is provided in the corner region of the baking sheet 1, extending essentially in the shape of an L, both in the edge region 11 and in the front region 13. The notch 15 is formed correspondingly in all four corner regions of the baking sheet 1. An essentially U-shaped sliding clip 17 of high-grade steel may be clipped into the lateral edge region 11 or the front region 13 and the corresponding rear region. For reasons of simplicity, only the front end portion of the sliding clip 17 is represented in FIG. 2. Each sliding clip 17 has in both its corner regions a respective bump-shaped elevation 19, which has an essentially L-shape corresponding to the notch 15. In the clipped-in or installed state, the sliding clip 17 respectively protrudes with its elevation 19 out of the notch 15, and thereby extends slightly below the underside of the enameled edge region 11. As such, the baking sheet 1 rests and is guided respectively in the enameled guideways on both sides only by the two high-grade steel elevations 19 of the sliding clip 17. Otherwise, the remainder of the sliding clip 17 is configured such that it is concealed within the edge region 11 of the slide-in unit baking sheet 1.

To also allow other enameled baking sheets, already on the market, to be retrofitted with the high-grade steel sliding clip, the sliding clip according to the exemplary embodiment of the invention may also be formed from two individual parts. The four partial sliding clips can then be clipped respectively into each of the corner regions of the baking sheets that are to be retrofitted. In this embodiment, a material saving is made possible during the production of the high-grade steel sliding clips.

We claim:

1. A slide-in unit for a baking oven with enameled guideways in sidewall regions, the slide-in unit comprising:

a tray with two opposite lateral supporting regions each respectively with a curled lateral edge region having at least one notch; and a sliding clip clampingly secured in said edge region of said supporting regions, said clip protruding from said at least one notch as a sliding support for said tray.

2. The slide-in unit according to claim 1, wherein said tray is enameled.

3. The slide-in unit according to claim 1, wherein said edge region is downwardly curled.

4. The slide-in unit according to claim 1, wherein said clip has a top and is covered on said top by said edge region.

5. The slide-in unit according to claim 1, wherein said clip is two clips, a respective one of said two clips disposed in each of said two supporting regions.

6. The slide-in unit according to claim 1, wherein said at least one notch is two notches formed in said edge region and said two notches are spaced apart from one another in said edge region.

7. The slide-in unit according to claim 6, wherein said edge region has a length with two ends and said two notches are spaced apart from one another at said ends of said edge region.

8. The slide-in unit according to claim 1, wherein said tray has corner regions and sides and said at least one notch is formed in a respective one of said corner regions and extends into respective neighboring sides of said tray.

9. An improved support for a slide-in unit having two opposite lateral supporting regions each respectively with a downwardly curled lateral edge region having at least one notch for a baking oven with enameled guideways in sidewall regions, the improvement comprising:

a sliding clip clampingly secured in the edge region of the supporting regions of the slide-in unit, said clip protruding from the at least one notch of the edge region as a sliding support for the slide-in unit.

* * * * *